United States Patent [19]

Nam

[11] Patent Number: 4,627,336

[45] Date of Patent: Dec. 9, 1986

[54] APPARAUTS FOR STORAGE OF PERISHABLES

[76] Inventor: Kang H. Nam, 15634 E. Amar Rd., #E, La Puente, Calif. 91744

[21] Appl. No.: 779,921

[22] Filed: Sep. 25, 1985

[51] Int. Cl.[4] ..... B65D 81/20; B65D 51/16

[52] U.S. Cl. ..... 99/467; 53/510; 220/367; 220/372; 220/373; 426/418; 426/419; 141/63; 422/292

[58] Field of Search ..... 426/106, 112, 118, 410, 426/397, 418, 419; 53/432–434, 512–514; 99/467, 472; 220/367, 371, 372, 373; 137/588; 141/66, 64, 63, 18, 7, 6, 20

[56] References Cited

U.S. PATENT DOCUMENTS

| | | | |
|---|---|---|---|
| 541,368 | 6/1895 | Leak et al. | 426/418 |
| 609,590 | 8/1898 | Santa Cruz | 426/418 |
| 1,259,410 | 3/1918 | Kapadia | 426/419 |
| 1,406,380 | 2/1922 | Heath et al. | 53/432 |
| 1,637,311 | 7/1927 | Hawley | 426/418 |
| 2,001,628 | 5/1935 | Nierinck | 426/418 |
| 2,160,367 | 5/1939 | Maxfield | 53/433 |
| 2,353,029 | 7/1944 | Graham | 426/419 |
| 2,402,199 | 6/1946 | MacDonald | 426/418 |
| 2,483,064 | 9/1949 | Reich | 426/418 |
| 2,506,769 | 5/1950 | Bergstein | 53/432 |
| 2,518,100 | 8/1950 | Tomkins | 426/418 |
| 2,789,059 | 4/1957 | Lindewald | 426/418 |
| 3,286,430 | 11/1966 | Esty | 53/432 |
| 3,360,382 | 12/1967 | Miller | 426/418 |
| 3,407,078 | 10/1968 | Schlicter | 426/418 |
| 3,473,704 | 10/1969 | O'Donnell | 141/20 |
| 3,516,217 | 6/1970 | Gildersleeve | 53/432 |
| 3,600,127 | 8/1971 | Kereluk | 426/316 |
| 3,610,516 | 10/1971 | Esty | 53/434 |
| 3,715,860 | 2/1973 | Esty | 426/418 |
| 3,750,362 | 8/1973 | Kishpaugh et al. | 53/433 |
| 3,943,987 | 3/1976 | Rossi | 53/432 |
| 4,066,401 | 1/1978 | Solomon | 99/467 |
| 4,449,243 | 5/1984 | Platel | 426/410 |
| 4,513,015 | 4/1985 | Clough | 426/396 |

FOREIGN PATENT DOCUMENTS

| | | | |
|---|---|---|---|
| 318534 | 9/1929 | United Kingdom | 426/418 |
| 484668 | 5/1938 | United Kingdom | 426/418 |

*Primary Examiner*—Steven L. Weinstein

[57] ABSTRACT

An apparatus for preserving perishables fresh and long storage of corrosive material by filling the container with an inert gas and sealing the gas therein.

1 Claim, 7 Drawing Figures

FIG. 1
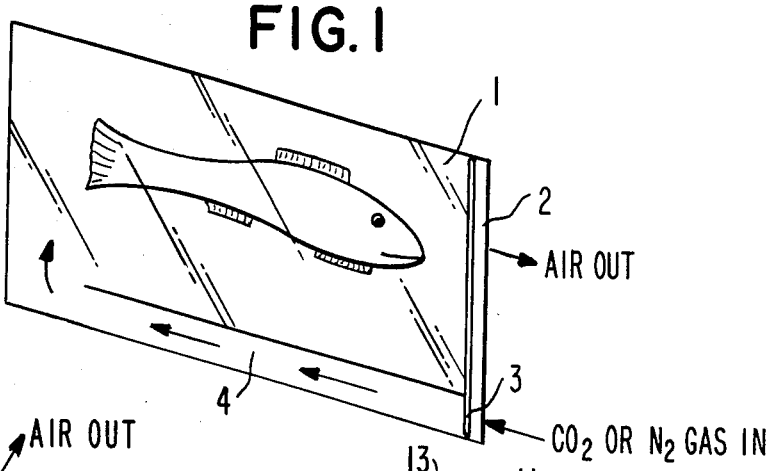
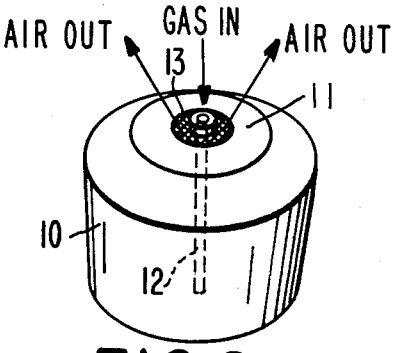
FIG. 2
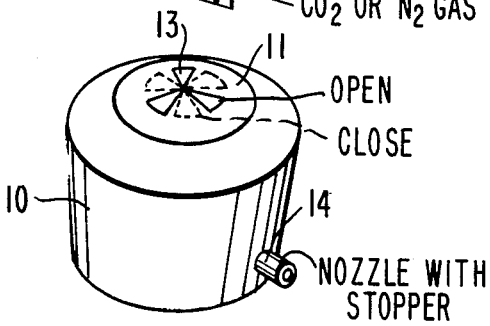
FIG. 3
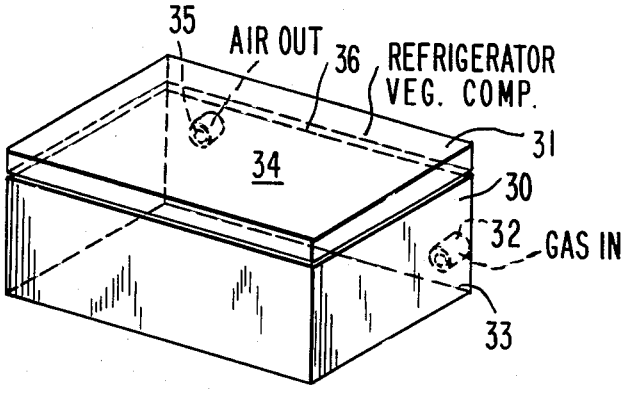
FIG. 4
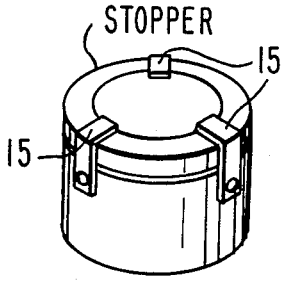
FIG. 5
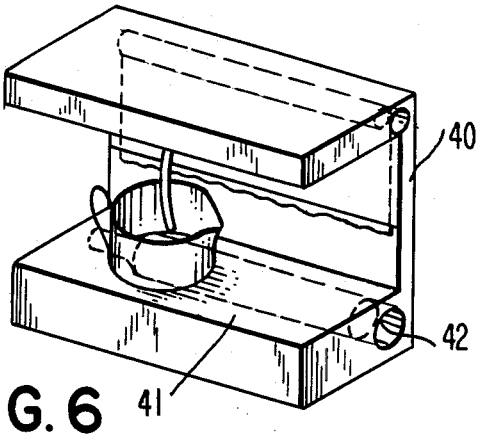
FIG. 6
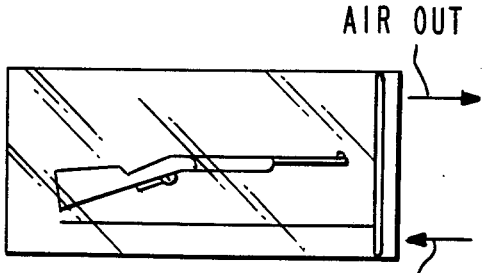
FIG. 7

APPARAUTS FOR STORAGE OF PERISHABLES

BACKGROUND OF THE INVENTION

Field of the Invention

This invention relates to containers for food or storage of corrosive material more particularly, containers filled with inert gas for preserving their contents.

SUMMARY OF THE INVENTION

It is the objective of this invention to provide containers for preserving or long-term storage of corrosive material such as iron by replacing air of the containers with an inert gas.

BRIEF DESCRIPTION OF THE DRAWINGS

FIG. 1 is a perspective view of a method to preserve freshness of food shown in accordance with the present invention;

FIG. 2 is a perspective view of one phase of the method;

FIG. 3 is a perspective view of another phase of the method;

FIG. 4 is a perspective view of the invention using a refrigerator vegetable compartment.

FIG. 5 is another form of the invention method;

FIG. 6 is a perspective view of another method, and

FIG. 7 is a front elevational view of the method to protect against corrosive action.

DETAILED DESCRIPTION

A container in accordance with the present invention can be of any suitable shape, such as a flat bag 1 as shown in FIG. 1. One end 2, of the bag is provided with a zip lock closure, 3. A channel 4, disposed at the bottom of the bag for filling of inert gas and replacing air therein as indicated by arrows. The inert gas referred to herein may be either one of the following, nitrogen, carbon dioxide, argon and the like which does not react with the food stored, nor with the material stored therein. The inert gas pressure is about 1–5 atmosphere.

In another embodiment, the container in accordance with the present invention may be a round pot as shown in FIG. 2 and 3. The pot 10 is provided with a lid 11. In one version, the lid 11 is provided with a centrally located, vertically extended tubular vent 12 for introducing inert gas into the pot and a concentric vent 13 coaxial with the central tubular vent is provided for venting air.

FIG. 2 shows a screen bridging across the vent for securing the tube to the lid.

Optionally the lid can be provided with an open-close vane 13 and an inert gas inlet 14, is located in the vicinity of its bottom. In another design, the lid can be locked in place by U-shape clamps 15 as indicated in FIG. 5 in the event the inert gas exceeds 1 atmosphere.

FIG. 4 shows a rectangular container for storing vegetables or fruits or any perishables. Said container 30 is provided with a tightly fit lid 31. An inert gas inlet 32 is provided at lower edge 33 of the side wall 34. An air outlet 35 is at the upper edge 36 of the same wall. Means for plugging said inlet and outlet are provided.

FIG. 6 is a compact of a housing 40, having a base 41 for housing an inert gas tank 42. On said base, there is placed a pot for storing food. Extending through the pot, there is a tube 43 connected to a roof 44, parallel to the base. Within said roof, there is a channel 45 longitudinal to the roof with one end connected to the inert gas tube and the other for connecting to the inert gas tank. The pot can be the one shown in FIG. 2.

FIG. 7 shows a bag similar to the one as shown in FIG. 1 for long term storage of corrosive material, such as a gun.

While various changes may be made in the detail construction, it is understood that such changes will be within the spirit and scope of the present invention, as is defined by the appended claims.

What I now claim is:

1. An assembly for storage of perishables, comprising, in combination, a circular pot for containing said perishables, and a housing supporting said pot; said pot including a removable lid thereupon, a vertical tube through a center of said lid extending into a lower portion of an interior of said pot for entry of inert gas thereinto, a circular vent opening through said lid surrounding said tube concentrically, and a screen means extending across said vent opening for centrally securing said tube to said lid; and said housing including a base upon which said pot is placed, an inert gas tank inside said base, said housing including a roof parallel to said base and spaced above said pot, a tube connected to the roof for connecting to said vertical tube, a channel inside said roof, one end of said channel being connected to said tube connected to said roof, and the other end of said channel being connected to said inert gas tank for said gas to travel from said tank to said pot.

* * * * *